US006508070B1

(12) United States Patent
Palmer

(10) Patent No.: US 6,508,070 B1
(45) **Date of Patent: *Jan. 21, 2003**

(54) WATER CHILLER

(75) Inventor: David G. Palmer, Lincoln, NE (US)

(73) Assignee: Palmer Technologies, Inc., Lincoln, NE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 10/051,480

(22) Filed: Jan. 18, 2002

Related U.S. Application Data

(60) Provisional application No. 60/263,356, filed on Jan. 22, 2001.

(51) Int. Cl.[7] ..... F25D 17/02; B67D 5/62

(52) U.S. Cl. ..... 62/201; 62/389

(58) Field of Search ..... 62/364, 201, 389, 62/457.3; 222/146.6

(56) References Cited

U.S. PATENT DOCUMENTS 2,674,106 A * 4/1954 Hill ..... 62/141
5,304,286 A 4/1994 Palmer ..... 202/167
5,367,879 A * 11/1994 Doke et al. ..... 62/3.6
5,699,669 A * 12/1997 Gebhard ..... 62/3.64
6,112,541 A * 9/2000 Greene ..... 62/389
6,237,345 B1 * 5/2001 Kalman et al. ..... 62/3.64

* cited by examiner

*Primary Examiner*—Denise L. Esquivel
*Assistant Examiner*—Melvin Jones
(74) *Attorney, Agent, or Firm*—Van Dyke, Gardner, Linn & Burkhart, LLP

(57) ABSTRACT

A water chiller includes a cooling tank and a cooling device positioned at an upper portion of the cooling tank. The cooling device includes a cooling probe positioned within the cooling tank at an upper region thereof and being operable to cool the water at the upper region of the cooling tank. The cooled water increases in density and descends toward the bottom or lower region of the cooling tank, while warmer water positioned in the lower region rises upwards toward the cooling probe, where it is cooled by the cooling probe. The water cooler thus continually cools and mixes the water within the cooling tank to maintain the water at a cool temperature. The cool water at the lower region of the tank is discharged from the cooling tank at an outlet positioned at or near the bottom of the cooling tank.

34 Claims, 3 Drawing Sheets

WATER CHILLER

CROSS REFERENCE TO RELATED APPLICATION

This application claims priority on U.S. provisional application, Ser. No. 60/263,356, filed Jan. 22, 2001 for IN-LINE WATER CHILLER, which is hereby incorporated herein by reference.

FIELD OF THE INVENTION

The present invention relates generally to water cooling devices and, more particularly, to an in-line water chilling device which cools water from a water supply source and provides cooled water to an outlet or dispenser, such as a faucet or the like.

BACKGROUND OF THE INVENTION

Chilled water has become a popular beverage as a consequence of the popularity of bottled water dispensers. This has led to a demand for chilled drinking water to be available 'on tap' at a kitchen sink in the home or at the sink in a motor home. Typically, water coolers or chillers include a cooling probe to cool the water within a tank such that the water discharged from the tank is cool for drinking. To date, such chillers have always included the cooling probe at the bottom of the tank.

SUMMARY OF THE INVENTION

The present invention is intended to provide an in-line water chiller or cooler which receives un-cooled water from a water supply source and discharges cooled water to an outlet, such as a faucet at a kitchen sink or the like. The in-line water chiller or cooler of the present invention includes a compact chiller tank and associated cooling probe that maximizes the volume of chilled water available. In the home, water might be supplied to the chiller tank after passing it through a special style of filter, a reverse osmosis system, or the like. In a motor home or the like, the water source could be a 5 gallon bottle or other volume container of purchased bottled water together with a suitable pump or pressure system.

According to an aspect of the present invention, an in-line water cooler for cooling a supply of water includes a cooling tank, a cooling device positioned within the cooling tank at an upper portion thereof, and a discharge outlet at a lower portion of the cooling tank. The water supply is connected to the cooling tank and provides a supply of uncooled water to the cooling tank. The cooling device is operable to cool the uncooled water, whereby the cooled water descends to the lower portion of the tank, such that the discharge outlet is operable to discharge cooled water from the lower portion of the cooling tank. The positioning of the cooling device at the top of the tank cools the water adjacent to the cooling device, thereby causing the water to become more dense, such that the cooler water sinks or descends downward away from the cooling device toward the lower portion of the tank. Any warmer, and thus less dense, water in the lower portion of the tank will then rise toward the upper portion and toward the cooling device. The cooling device arrangement of the present invention thus causes a continual mixing of the water inside the chiller tank by convection such that the water within the tank cools uniformly to a desired temperature.

Preferably, the in-line water cooler further includes a fan and heat sink device positioned at an upper end of the water tank and operable to direct heated air from the cooling device upward and away from the cooling tank. In one form, the water cooler includes a seal and a housing, with the seal positioned generally above the heat sink and the tank, which are all positioned within the housing. The discharge air from the fan is vented upward through the seal and out above the seal, while inlet air comes into the housing below the seal, such that the inlet and outlet air are separated from one another, thereby providing a lower temperature inlet air to the water chiller and, thus, improving the efficiency and performance of the water chiller. Preferably, the housing is secured to a wall of a cabinet or the like, with an opening cut through the wall at a location above the seal, such that the air discharged from the fan is discharged to another compartment away from the water chiller, to further optimize the performance of the system.

In another form, the water cooler may be located within a cabinet or the like having an upper vent and a lower vent. The heated air discharged by the fan rises and thus vents out through the upper vent, while the lower vent provides an inlet opening for ambient air to be drawn into the cabinet, whereby the cooling tank is generally surrounded by air which is generally at the temperature of the ambient air coming in through the lower vent.

According to another aspect of the present invention, an in-line water cooler for cooling water from a water supply includes a cooling tank, a cooling device and a housing. The cooling device is operable to cool the water and includes a fan positioned at an upper end of the cooling tank for discharging heated air generated by the cooling device when it is activated to cool the water. The cooling device further includes a seal, which separates and seals an upper portion from a lower portion of the housing. The tank is positioned in the lower portion of the housing. The fan is positioned at the seal and is operable to discharge the heated air into the upper portion of the housing and through a vent at the upper portion, while inlet air is provided within the housing through at least one inlet opening positioned below the seal, such that the inlet air does not mix with the discharged heated air and thus remains at a lower temperature. Preferably, the housing is mounted to a wall of a cabinet or the like, with the upper vent being an opening cut through the cabinet at a position generally corresponding to the upper portion of the housing above the seal, such that the heated air discharged by the fan is discharged through the opening in the wall of a cabinet and into another chamber away from the cabinet area at which the water tank is positioned. This provides for optimal performance of the cooling device, since the inlet air into the housing of the water chiller is maintained at a lower temperature because it is not mixed with the heated air being discharged from the cooling device.

Preferably, the cooling device is positioned within the cooling tank at an upper portion thereof, while a discharge outlet for discharging cooled water from the cooling tank is positioned at a lower portion of the cooling tank.

These and other objects, advantages, purposes and features of the present invention will become apparent upon review of the following specification in conjunction with the drawings.

BRIEF DESCRIPTION OF THE DRAWINGS

FIG. 1 is a perspective view of a water chiller in accordance with the present invention, as mounted within a kitchen cabinet or the like;

DESCRIPTION OF THE PREFERRED EMBODIMENTS

Figure 2:
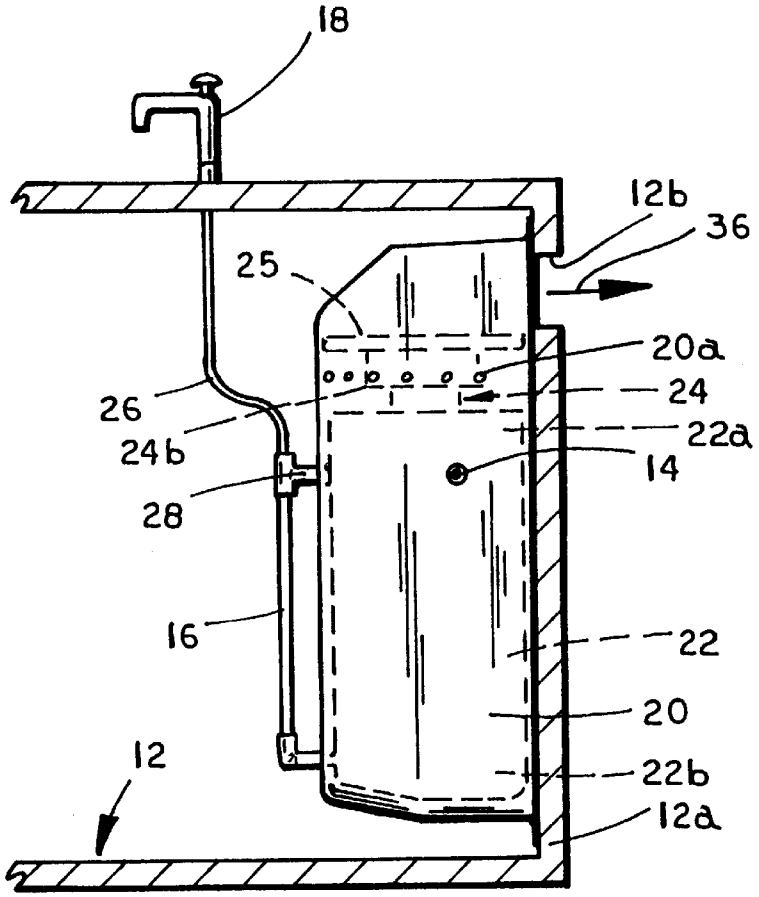
FIG. 2 is a side elevation of the water chiller of FIG. 1.
Figure 1:
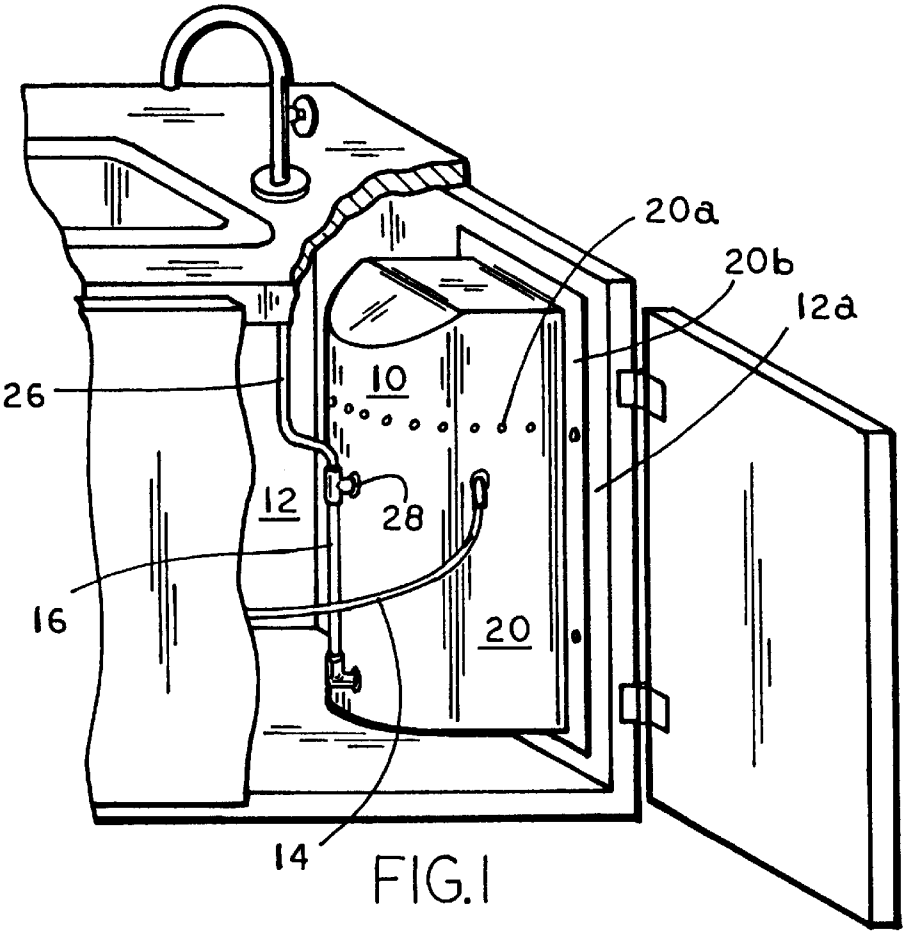
Figure 4:
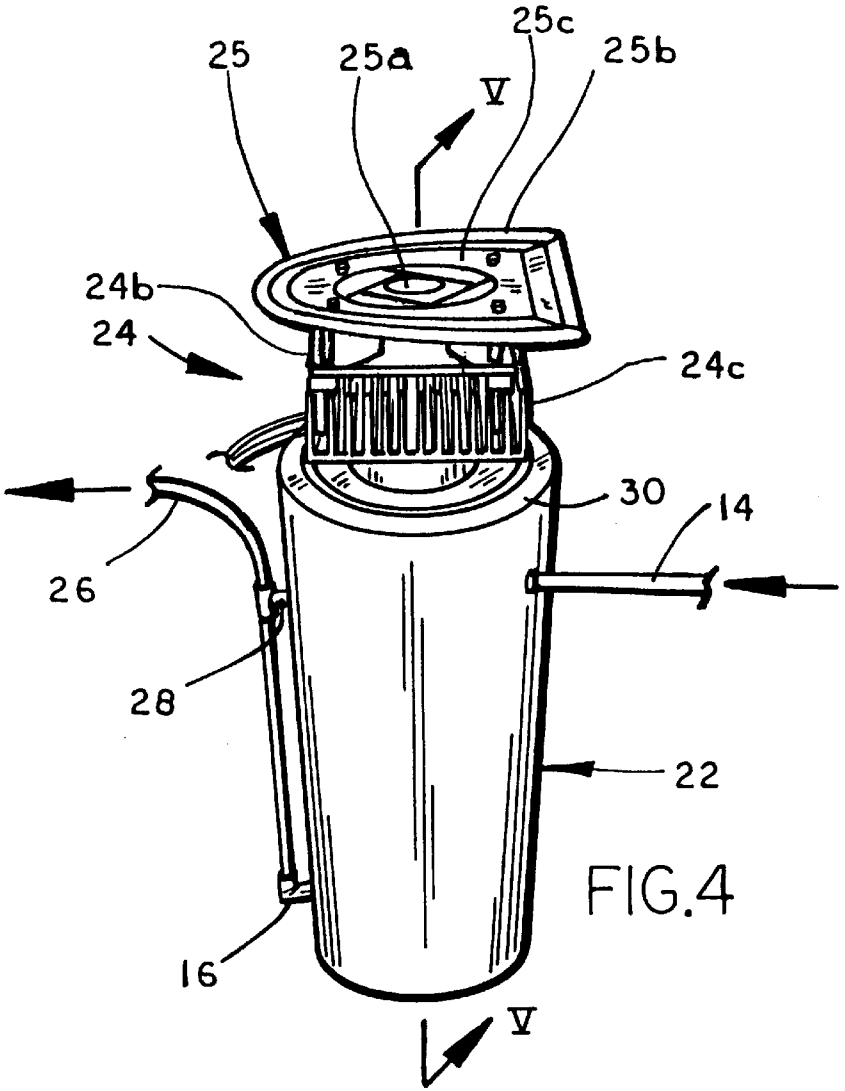
FIG. 4 is a perspective view of the water chiller of FIGS. 1–3, with the housing removed.
Figure 3:
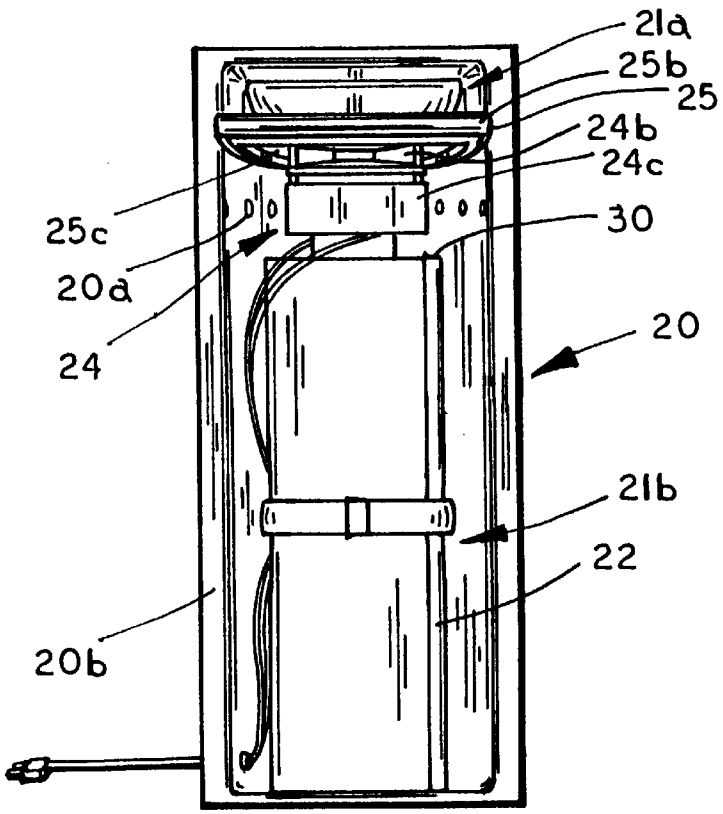
FIG. 3 is another side elevation of the water chiller of FIGS. 1 and 2, removed from the cabinet.

Referring now to the drawings and the illustrative embodiments depicted therein, an in-line water chiller 10 is positioned within a cabinet 12 and is operable to cool water which is supplied to the water chiller through an inlet line 14, and discharge the cooled water out a discharge line 16 (FIGS. 1, 2 and 4). In-line water chiller 10 includes a housing 20, which substantially encases a water tank 22 and a cooling device 24, as shown in FIGS. 2 and 3. In the illustrated embodiment, housing 20 is secured to a wall 12*a* of the cabinet 12 to contain or encase water tank 22 and cooling device 24 between housing 20 and wall 12*a*. Water enters the chiller tank 22 close to an upper portion or top 22*a* of tank 22, through inlet conduit 14, while chilled water exits through outlet conduit 16, which is located close to a base or lower portion 22*b* of the chiller tank 22. The outlet conduit 16 is further connected to a delivery or dispensing conduit 26, through which the chilled water is communicated to a dispensing valve or faucet 18 or the like. A connecting conduit 28 may connect from the upper portion 22*a* of the chiller tank 22 to the water delivery conduit 26 to insure that little, if any, air will become trapped inside the chiller tank 22. Chiller tank 22 is preferably wrapped with insulation 30 to minimize the flow of heat from the surrounding air into the chilled water stored inside the chiller tank 22.

Figure 5:
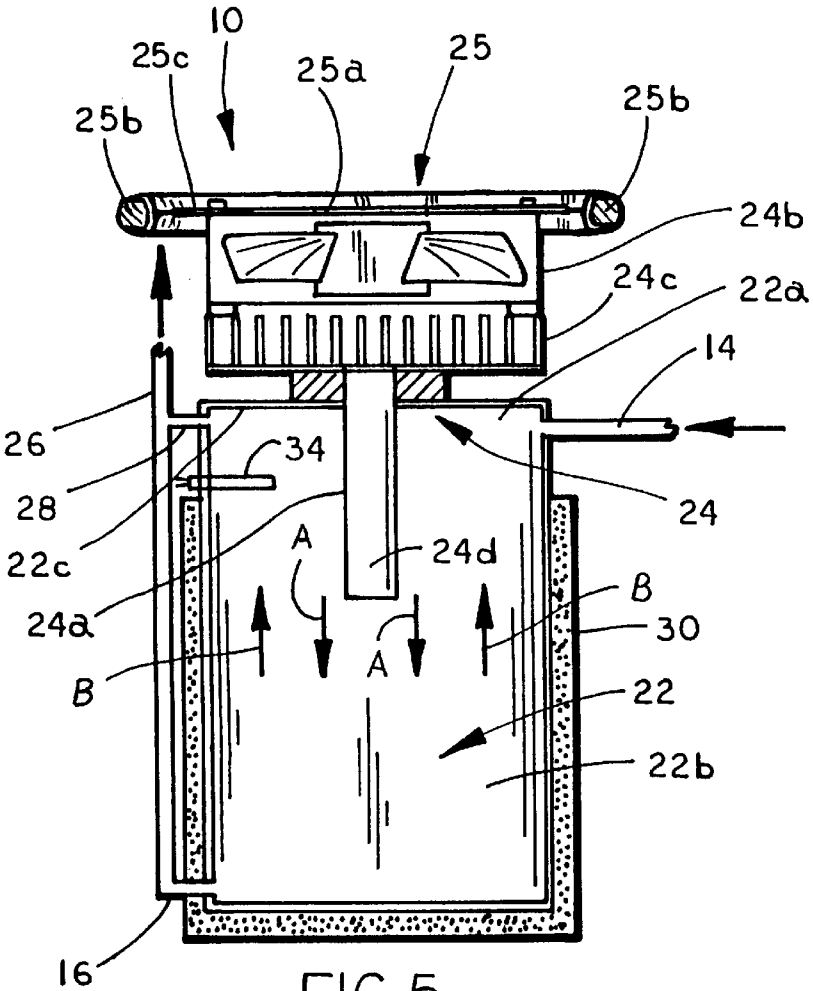
FIG. 5 is a partial sectional view of the water chiller of FIGS. 1–4.

As best shown in FIGS. 3 and 4, chiller tank 22 may be a generally cylindrical tank for holding water therein. Inlet conduit 14 provides water from the supply source (not shown) to upper portion 22*a* of chiller tank 22, while discharge conduit 16 discharges the chilled water from lower region 22*b* of tank 22. The water source provides water to inlet conduit 14 under pressure, such as by a pump or the like or gravity. The discharged water is also pressurized by the pressurized water supply source and thus may discharge the water upward toward the dispensing conduit 26 and further to the faucet or dispensing valve 18 at the sink or other appropriate location. The connecting conduit 28 connects between discharge conduit 16 and dispensing conduit 26 and functions to allow any air at the upper most portion or top of the tank 22 to be discharged from the tank via the dispensing conduit 26 when the valve 18 is opened. Preferably, the size of connecting conduit 28 is selected such that the flow through the conduit 28 is less than approximately 10 percent of the flow through the outlet conduit 16 and dispensing conduit 26, as best shown in FIG. 5.

Cooling device 24 is positioned at the upper end of water chiller 10 and may comprise any known cooling apparatus for cooling a volume of water. In the illustrated embodiment, cooling device 24 comprises a thermoelectric cooling device. However, cooling device 24 may be a conventional compressor/refrigeration system or other known means for cooling a volume of water, without affecting the scope of the present invention. Cooling device 24 includes a cooling probe 24*a* and a cooling fan 24*b* and heat sink channels 24*c*. Cooling probe 24*a* is mounted through the top 22*c* of the chiller tank 22 and protrudes downwards into the water 32 within the tank 22, as shown in FIG. 5. In the illustrated embodiment, the cooling probe 24*a* is associated with a thermoelectric cooling device, such as the type made by Cool Works Inc. of San Rafael, Calif., and marketed under the name 'Ice Probe'.

Heat is generated by the cooling device 24 as the probe 24*a* operates to cool the water. The heat is dissipated using the heat sink channels 24*c* of cooling device 24 and/or by discharging the heated air away from the water chiller 10 via fan 24*b*, preferably through a separate vent above a seal member or fan plate 25, as discussed below. Cooler inlet air is drawn in through the heat sink channels 24*c* by the cooling fan 24*b* and the warm air (shown generally at 36 in FIG. 2) warmed by the heat sinks 24*c* is thus discharged vertically upwards away from the chiller tank 22 by the fan 24*b*, such that the air immediately surrounding cooling device 24 is maintained at a generally lower temperature than that of the heated air being discharged by fan 24*b*.

In one version of the present invention, a temperature sensitive switch or thermostatic device or probe 34 is mounted between a lower end 24*d* of the cooling probe 24*a* and the top 22*c* of the cooling tank 22. The probe 34 is operable to activate and deactivate the cooling probe 24*a* in response to the temperature of the water surrounding the probe 34.

During operation of water chiller 10, chiller tank 22 is initially filled with water at ambient temperature. The water is supplied via inlet pipe 14, which is connected to the pressurized water source or the like (not shown). Electric power is supplied to the cooling device 24, which causes the cooling probe 24*a* to lower in temperature. The heat developed outside the chiller tank 22 as a consequence of the thermoelectric process is conducted away as warm air 36 via fan 24*b* and heat sink channels 24*c*.

Because the cooling probe 24*a* is at a lower temperature, the water inside the tank 22 adjacent to the cooling probe 24*a* becomes lower in temperature and thus becomes more dense. The higher density, cooler water thus sinks downward (shown generally by arrow A in FIG. 5) away from the probe and is replaced by lower density, warmer water rising up from the lower region 22*b* of the tank 22 (shown generally by arrow B in FIG. 5). This arrangement causes the continual mixing of the water 32 inside the chiller tank 22 by convection, such that the body of water 32 cools uniformly. After a period of time, all of the water 32 inside the chiller tank 22 approaches a desired temperature. Preferably, the desired temperature is approximately 4 degrees Celsius, which is the temperature when water has the highest density. Further cooling by the cooling probe 24*a* will result in a band of even lower temperature water forming in the top section 22*a* of the chiller tank 22 between the lowest point 24*e* of the probe 24*a* and the top 22*c* of the tank 22. Water adjacent to the thermostatic device or probe or sensor 34 will cool the probe 34 to below its trip point, which is preferably between approximately 4 degrees Centigrade and approximately 1 degree Centigrade. When the probe 34 is cooled to this temperature, the probe 34 will cause the cooling device 24 to turn off. When the temperature adjacent to the probe 34 later rises above the set or trip point, the cooling device 24 will be re-activated to cool the water within the tank 22.

When water is drawn from the sink faucet 18, chilled water is removed from the outlet 16 at or near the bottom 22*b* of tank 22 and water enters the top or upper region 22*a* of tank 22 via inlet 14 and the pressurized water source. By limiting or regulating the flow rates into, out from and through the chiller tank 22, little mixing of the chilled and warmer water will occur within tank 22, and the warmer water will generally form a layer on top of the chilled water. The warmer water thus remains in the upper region 22*a* of the tank 22 and close to the cooling probe 24*a*, where it starts to decrease in temperature or cool when the cooling probe 24*a* is activated. Because the cooler water remains at the lower region 22*b* of the cooling tank, the cooler water is dispensed from the discharge tube 16. Further drawing of water from the chiller tank 22 via faucet 18 results in chilled water being dispensed which is of a similar temperature to the previous draw.

In another embodiment of the present invention, the water chiller may not include a thermostatic sensor device or probe and the cooling device may run continuously. To minimize the formation of an ice layer at the top of the tank, which could block the inlet conduit 14 and connecting conduit 28, the upper section 22*a* of chiller tank 22 is preferably not insulated in such an embodiment.

In a preferred embodiment of the present invention, the chiller tank 22 has a height several times its diameter, in order to minimize mixing between the chilled water and the make-up or supply water that enters the tank 22 when chilled water is drawn. This promotes the layering effect and keeps most of the chilled water already in the chiller tank 22 from being warmed by the make-up water. When used with a thermo-electric cooling device, the chiller tank 22 preferably has a volume equivalent to at least one day's typical usage of chilled water.

In order to optimize the performance of the water chiller 10, the temperature of the air used for cooling the heat sink channels 24*c* should be kept at as cool a temperature or as close to ambient temperature as possible. In order to minimize the temperature of the inlet air, fan plate or sealing member 25 is positioned within housing 20 to separate and define an upper portion or chamber 21*a* of housing 20 and a lower portion or chamber 21*b* of housing 20 (FIG. 3), with tank 22 and cooling device 24 being positioned in the lower chamber 21*b*. Housing 20 includes a plurality of inlet openings or vent openings 20*a* for allowing inlet air from within the kitchen cabinet 12 or the like to be inducted to the heat sink channels 24*c* of cooling device 24. As shown in FIGS. 2 and 3, the inlet openings 20*a* are positioned below sealing member 25. The fan 24*b* is mounted immediately beneath sealing member 25 and functions to discharge the heated air from the cooling device 24 upward through an opening 25*a* in sealing member 25. Sealing member 25 includes a flexible or rubber seal portion 25*b* extending around an outer circumference of a plate portion 25*c* of sealing member 25, such that the seal portion 25*b* substantially uniformly engages an inner surface of the housing 20 and the wall 12*a* of cabinet 12, in order to substantially preclude air from passing around seal 25*b* between the upper chamber 21*a* and the lower chamber 21*b* of housing 20. As shown in FIG. 2, an opening 12*b* in wall 12*a* of cabinet 12 is formed to be positioned above sealing member 25 so as to be aligned with upper chamber 21*a* of housing 20 when housing 20 is secured to wall 12*a* of cabinet 12. Accordingly, as heat is generated by cooling device 24, the heated air is discharged upwardly through opening 25*a* of sealing member 25 via operation of fan 24*b*. The heated air is then discharged through passageway or opening 12*b* in wall 12*a* of cabinet 12, such that the heated air is discharged to an area remote from the inlet openings 20*a* of housing 20. This prevents the discharged heated air from mixing with the inlet air, such that the inlet air remains at a lower temperature corresponding to the ambient temperature within the cabinet 12. Housing 20 and sealing member 25 thus function to provide for a lower inlet air temperature for the air surrounding the cooling tank and cooling device, which enhances performance of the cooling device and thus of the water chiller of the present invention.

When in operation, the temperature of the cooling probe 24*a* is dependent upon the temperature of the cooling air entering the sink channels 24*c* of cooling device 24 this is generally described by the following equation:

$$T_{Probe}=T_{air}-K;$$

wherein $T_{probe}$ is the temperature of the cooling probe, $T_{air}$ is the temperature of the air entering the sink channels 24*c* and K is a constant value, which may vary between 30 and 40 degrees Fahrenheit and will depend on the particular design and application of the water chiller. For example, if the constant is 35 degrees Fahrenheit, any air temperature above 67 degrees Fahrenheit would preclude the formation of ice around the chiller probe 24*a*, because the probe would have a surface temperature of above 32 degrees Fahrenheit. Under such conditions, an increase in the temperature of the air ($T_{air}$) will result in an increase in the temperature of the probe ($T_{probe}$) and thus raise the temperature of the chilled water. When the temperature of the air increases a significant amount, chiller performance may be substantially impaired.

The fan tray or sealing member 25 thus functions to effectively separate the housing 20 into two compartments 21*a* and 21*b*. The upper compartment 21*a* forms a duct for the removal of the heated air generated by the cooling device, while the lower compartment 21*b* receives cooler inlet air through the inlet openings 20*a* of housing 20. As shown in FIG. 1, the housing 20 may be attached to the cabinet wall 12*a* via screws or other appropriate fasteners securing flanges 20*c* of housing 20 to the cabinet wall 12*a*. Prior to attachment, opening 12*b* is cut into the wall 12*a* of cabinet 12 so that the heated air passes out of the cabinet in which the chiller is mounted. The cabinet or area into which the heated air is discharged may be another adjacent kitchen cabinet, such as a storage cabinet for pots or other kitchen hardware, or may be an opening into which a dishwasher is installed, or into the room in which the cabinet is installed or even to the outside of the building in which the cabinet is installed. The heated air is thus discharged to an area remote from the inlet openings of the housing 20, in order to maintain the air passing through openings 20*a* at a low, ambient temperature. By discharging the heated air to a remote location, not only does the inlet air within the cabinet not increase, but the inlet air may even decrease due to the cool temperature of the tank 22 and of the discharged water in delivery lines 16 and 26, since they may not be perfectly insulated. This can result in slightly cooling the air inside the cabinet, whereby the chiller 10 approaches its maximum and optimal performance. Although shown as having a semi cylindrical housing mounted to a wall of a cabinet, a generally enclosed housing may be provided which rests on a floor of a cabinet or the like and has a discharge opening in the upper chamber which is in communication with a remote area, such as via a flexible vent hose or pipe or the like, without affecting the scope of the present invention. The vent hose may be connected to an opening in the cabinet or any other means for discharging the heated air to an area remote from the inlet opening in the housing.

Figure 6:
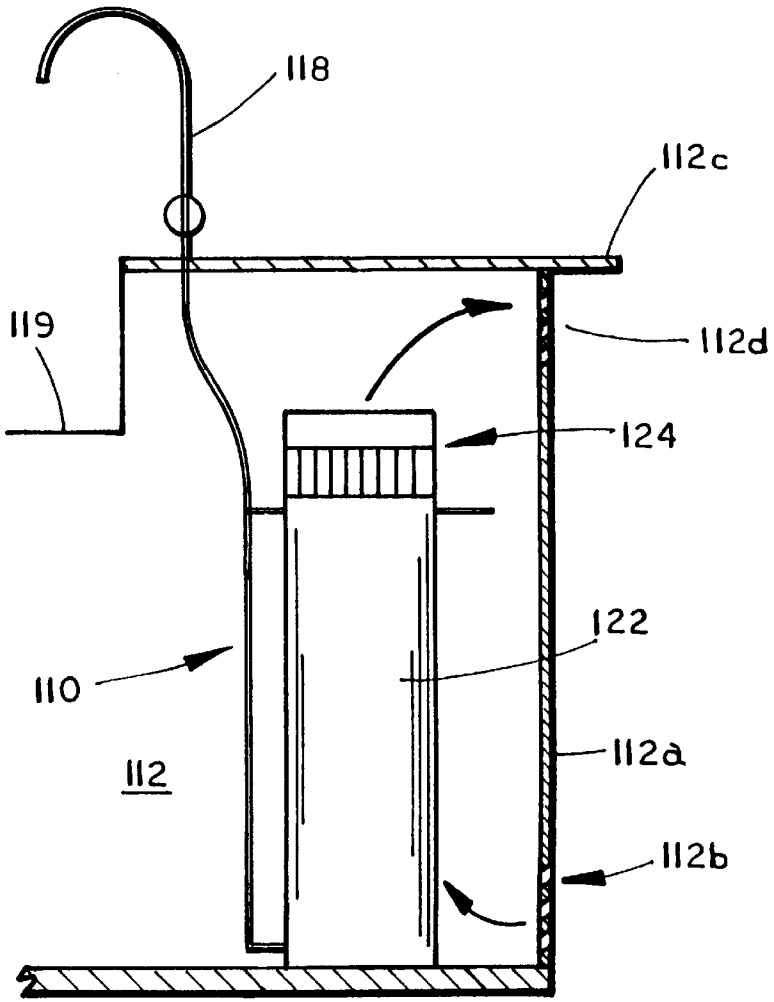
FIG. 6 is a side elevation of another water chiller in accordance with the present invention, as installed in a cabinet having upper and lower vent openings.

Referring now to FIG. 6, the placing of the cooling device on top of the chiller tank may also enhance cooling without the housing and fan tray arrangement discussed above. As shown in FIG. 6, an in-line water chiller 110 may be installed in a cabinet 112 under a countertop 112*c* adjacent to a faucet 118 and sink 119. A suitably sized inlet vent or opening 112*b* in the base of a wall 112*a* of the cabinet or cupboard enclosure 112, together with a suitably sized outlet vent or opening 112*d* in wall 112*a* close to the underside of the counter-top 112*c*, will result in a chimney effect, with the warmer air generated by a cooling device 124 of water chiller 110 escaping through vent 112*d* and out into the room or into another cabinet or the like, while ambient temperature air is drawn into the cabinet via vent 112*b* at or near floor level. The air passing the insulated chiller tank 122 will thus be approximately at ambient temperature, thereby minimizing heat flow through the insulation and into the chilled water within tank 122. Such an arrangement thus limits temperature build-up inside the cabinet 112.

Therefore, the present invention provides for an in-line water chiller which is operable to provide cool water to a discharge or dispensing valve or faucet. The water chiller includes a cooling tank and a cooling device positioned at an upper region of the cooling tank. The cooling device is operable to cool the water surrounding a cooling probe within the water, such that the water in the upper portion of the tank cools and, thus, becomes more dense and descends toward the lower portion of the tank. Any warmer water within the lower portion of the tank will then tend to rise upward as the cooled water descends toward the bottom. The present invention thus provides for a continual mixing of the water within the tank to maintain the water at a desired cool level.

By positioning the chiller probe at an upper region of the cooling tank, the water chiller of the present invention thus ensures a maximum volume of substantially uniformly cooled water within the cooling tank. The water chilled by the cooling probe sinks or descends and displaces any warmer water in the lower region of the tank, which then rises upward toward the cooling probe. This natural convection results in all of the water below the probe approaching the desired cool temperature. As the chilled water in the lower region of the tank is drawn from the faucet or dispensing valve, the warmer or uncooled supply water enters the upper region of the cooling tank close to the cooling probe, where it is generally confined and chilled by the cooling probe. The cooled water in the lower region of the cooling tank remains chilled and available for dispensing.

The present invention also provides for an improved system for providing cool air to be inlet to the cooling device of the water chiller, in order to enhance performance and efficiency of the water chiller. The water chiller includes a housing which substantially encases the cooling device and cooling tank and a sealing member which separates the housing into an upper and lower chamber. The cooling tank is positioned in the lower chamber, while heated air generated by the cooling device during operation is discharged into the upper chamber, and is further discharged through a vent opening to the another cabinet or room or the like which is remote from the cabinet at which the water chiller is positioned.

The water cooler of the present invention may be easily mounted to a side or back wall of a cabinet to minimize the footprint required for the cooler. The air intake high on the housing further minimizes the likelihood that the inlet vents may become blocked by other articles stored in the cabinet under the sink. The outlet vent vents air through the wall of the cabinet to discharge heated air out of the cabinet at which the water cooler is installed, in order to substantially preclude heat buildup within the cabinet which may impair the efficiency of the water chiller.

Changes and modifications in the specifically described embodiments can be carried out without departing from the principles of the invention, which is intended to be limited only by the scope of the appended claims, as interpreted according to the principles of patent law, including the doctrine of equivalents.

The embodiments of the invention in which an exclusive property or privilege is claimed are defined as follows:

1. A water cooler for cooling a supply of water, said water cooler being adapted to connect to a water supply, said water cooler comprising:

a cooling tank, the water supply being connected to said cooling tank;

a cooling device positioned within said cooling tank at an upper portion thereof;

a discharge outlet at a lower portion of said cooling tank, wherein the water supply provides non-cooled water to said cooling tank, said cooling device being operable to cool the non-cooled water, said discharge outlet being operable to discharge cooled water from said lower portion of said cooling tank, wherein said discharge outlet extends upward toward an upper end of said cooling tank; and a connecting conduit which connects said discharge outlet to said upper portion of said cooling tank.

2. The water cooler of claim 1, wherein the water supply provides non-cooled water at an upper portion of said cooling tank.

3. The water cooler of claim 2, wherein the flow of the water supply and the flow of the water being discharged are regulated to minimize mixing of the non-cooled water supply with cooled water within said cooling tank as the non-cooled water supply is added to said upper portion of said cooling tank.

4. The water cooler of claim 1, wherein the non-cooled water is cooled by said cooling device at said upper portion of said cooling tank, the non-cooled water increasing in density and mixing with the cooled water as the non-cooled water cools.

5. The water cooler of claim 1, wherein said discharge outlet has a first diameter and said connecting conduit has a second diameter, said first diameter being greater than said second diameter.

6. The water cooler of claim 1, wherein said connecting conduit defines a passageway which is approximately 10% of the size of a passageway defined by said discharge outlet.

7. The water cooler of claim 1 further including a temperature sensor at said upper portion of said cooling tank, said cooling device being activatable and deactivatable in response to said temperature sensor.

8. The water cooler of claim 1, wherein said cooling device comprises a thermo-electric cooling device having a cooling probe within said upper portion of said cooling tank.

9. The water cooler of claim 1, wherein said cooling tank includes a layer of insulation around an outer surface of said cooling tank.

10. The water cooler of claim 1, wherein said cooling device includes a cooling probe within said upper portion of said cooling tank and a fan and heat sink at an upper end of said cooling tank.

11. The water cooler of claim 10, wherein said fan and heat sinks are operable to direct heated air from said cooling probe upward and away from said cooling tank.

12. The water cooler of claim 10 further including a housing which substantially encases said cooling tank and said cooling device.

13. The water cooler of claim 12, wherein said housing includes an inlet and an outlet, said fan being operable to discharge heated air through said outlet to a location remote from said inlet.

14. The water cooler of claim 13, wherein said housing includes an upper chamber and a lower chamber, said outlet being at said upper chamber and said inlet being at said lower chamber, said cooling tank and said cooling device being positioned within said lower chamber.

15. The water cooler of claim 14 including a sealing member which separates and seals said upper chamber from said lower chamber.

16. The water cooler of claim 10, wherein said water cooler is located within a cabinet having an upper vent and a lower vent, said fan being operable to discharge the heated air upward toward the upper vent while ambient air is drawn into the cabinet via the lower vent, such that said cooling tank is surrounded by air at a substantially ambient temperature.

17. A water cooler for cooling a supply of water, said water cooler being adapted to connect to a water supply, said water cooler comprising:

a cooling tank, the water supply being connected to said cooling tank, said cooling tank including a layer of insulation around an outer surface of said cooling tank, wherein said layer of insulation is removed from an upper portion of said cooling tank to limit ice formation within said cooling tank at said upper portion of said cooling tank;

a cooling device positioned within said cooling tank at an upper portion thereof; and a discharge outlet at a lower portion of said cooling tank, wherein the water supply provides non-cooled water to said cooling tank, said cooling device being operable to cool the non-cooled water, said discharge outlet being operable to discharge cooled water from said lower portion of said cooling tank.

18. A water cooling system for cooling a supply of water and providing cool water to a dispenser, said water cooling system comprising:

a water cooler, said water cooler including a cooling tank, a cooling device which is operable to cool water within said cooling tank, the water supply and the dispenser being connected to said cooling tank, said cooling device including a fan for dissipating heated air generated by said cooling device as said cooling device operates to cool the water within said cooling tank, said fan being operable to discharge the heated air through an air outlet to a location separated and remote from an air inlet of said cooling device, such that the air surrounding said cooling tank and said cooling device is maintained at a substantially ambient temperature; and a housing for substantially encasing said water cooler, said housing including said air inlet, wherein said housing comprises an upper chamber and a lower chamber, said air inlet being at said lower chamber and said air outlet being at said upper chamber, said water cooler being positioned in said lower chamber, said fan being operable to discharge the heated air into said upper chamber.

19. The water cooling system of claim 18, wherein at least one wall of said housing comprises a wall of a cabinet at which said water cooler is positioned, said air outlet comprising an opening in said wall of said cabinet such that the heated air is discharged out from said cabinet.

20. The water cooling system of claim 19, wherein said housing includes a sealing member which functions to separate and seal said upper chamber from said lower chamber.

21. The water cooling system of claim 18, wherein said cooling device includes a cooling probe positioned within said cooling tank and at an upper region of said cooling tank, said dispenser being connected to a lower region of said cooling tank to dispense cool water therefrom.

22. The water cooling system of claim 21, wherein said cooling tank receives the supply of water at said upper region of said cooling tank.

23. The water cooling system of claim 22, wherein said water cooler includes a temperature device at said upper region of said cooling tank, said cooling device being activatable and deactivatable in response to said temperature device.

24. A water cooling system for cooling a supply of water and providing cool water to a dispenser, said water cooling system comprising:

a water cooler, said water cooler including a cooling tank, the water supply and the dispenser being connected to said cooling tank; and a cooling device which is operable to cool water within said cooling tank, said cooling device including a fan for dissipating heat generated by said cooling device as said cooling device operates to cool the water within said cooling tank, said fan being operable to induct air from a first air space and discharge heated air to a second air space, said second air space being separated from said first air space by at least one wall to limit mixing of air in said first and second air spaces.

25. The water cooling system of claim 24, wherein said water cooler is positionable within a chamber.

26. The water cooling system of claim 25, wherein said first air space is exterior of said chamber and said second air space is interior of said chamber.

27. The water cooling system of claim 25, wherein said first air space is interior of said chamber and said second air space is exterior of said chamber.

28. The water cooling system of claim 25, wherein said chamber comprises a cabinet.

29. The water cooling system of claim 28, wherein said first air space is exterior of said cabinet and said second air space is interior of said cabinet.

30. The water cooling system of claim 28, wherein said first air space is interior of said cabinet and said second air space is exterior of said cabinet.

31. The water cooling system of claim 24 including a housing for substantially encasing said water cooler.

32. The water cooling system of claim 31, wherein said housing comprises a first chamber and a second chamber, said fan inducting air from said first air space into said first chamber and discharging heated air into said second chamber and into said second air space.

33. The water cooling system of claim 32, wherein said water cooler is positioned in said first chamber.

34. The water cooling system of claim 32, wherein said first chamber comprises an air inlet to allow air from said first air space to be inducted into said first chamber and said second chamber comprises an air outlet to allow heated air to be discharged from said second chamber into said second air space.

* * * * *